US007156570B2

(12) United States Patent
Cetera

(10) Patent No.: US 7,156,570 B2
(45) Date of Patent: Jan. 2, 2007

(54) IMPLEMENT GRIP

(75) Inventor: Carl Cetera, Tenafly, NJ (US)

(73) Assignee: Cotapaxi Custom Design and Manufacturing, LLC, Carlstadt, NJ (US)

( * ) Notice: Subject to any disclaimer, the term of this patent is extended or adjusted under 35 U.S.C. 154(b) by 0 days.

(21) Appl. No.: 11/126,537

(22) Filed: May 10, 2005

(65) Prior Publication Data

US 2006/0147245 A1 Jul. 6, 2006

Related U.S. Application Data

(60) Provisional application No. 60/640,762, filed on Dec. 30, 2004.

(51) Int. Cl.
*A46B 5/02* (2006.01)
*A45C 13/22* (2006.01)

(52) U.S. Cl. ..... 401/6; 16/430

(58) Field of Classification Search ..... 401/6, 401/195; 74/551.9; 16/430, 436; D19/47, D19/51; D8/303, 305
See application file for complete search history.

(56) References Cited

U.S. PATENT DOCUMENTS 3,848,871 A * 11/1974 Sweet et al. ..... 473/549
4,729,271 A * 3/1988 Kenigson ..... 81/177.1
4,932,800 A 6/1990 Lin
4,951,533 A * 8/1990 Hillinger ..... 81/177.1
D324,478 S * 3/1992 Baer ..... D8/303
5,143,463 A 9/1992 Pozil
5,468,083 A 11/1995 Chesar
5,558,452 A 9/1996 Oka
5,579,668 A * 12/1996 Kozak ..... 81/439
5,738,401 A * 4/1998 Fan ..... 294/171
6,148,482 A * 11/2000 Maraman, Jr. ..... 16/421
6,203,225 B1 3/2001 Baudino
6,295,904 B1 * 10/2001 Webb ..... 81/492
6,379,065 B1 4/2002 Perry
D508,951 S 8/2005 Cetera

OTHER PUBLICATIONS

U.S. Appl. No. 29/215,041, Cetera.

* cited by examiner

*Primary Examiner*—David J. Walczak
(74) *Attorney, Agent, or Firm*—The Soni Law Firm

(57) ABSTRACT

A cushioned implement grip for an hand held implement which serves the dual purposes of increased user comfort and providing an improved gripping surface to better hold the implement. The grip is a generally tapered cylindrical shape and may further include gripping rings as raised or indentation structures on the surface of the grip. The invention may be slid on to the implement outer surface proximate the gripping end of the implement for use with an existing device. Alternatively, the grip may be formed integrally with or assembled onto an implement during manufacture or assembly.

8 Claims, 2 Drawing Sheets

IMPLEMENT GRIP

PRIORITY CLAIM

This application claims priority to provisional application No. 60/640,762, filed on Dec. 30, 2004, and should be considered a conversion of same to a non-provisional application.

BACKGROUND OF THE INVENTION

1. Field of the Invention

The present invention relates to grips applied to various handheld devices. More specifically, the present invention relates to a textured grip which would typically be used with a writing implement. The textured grip of the present invention may further include a pattern comprising small suction cups.

2. Description of the Prior Art

Grips are added to handheld devices to allow them to be held more securely and to provide a cushioning effect. The grip may be provided as an accessory to be added to a handheld implement or may be an integral part of a device. Grips made of leather, foam, rubber, and various synthetic materials are well known. Frequently, textures are added to a grip to increase the ability of a hand to hold on to the handheld device. These grips may be placed on sporting equipment such as tennis racquets or golf clubs. Other grips are placed on electronic devices such as calculators. Grips are also commonly placed on some writing implements to improve comfort during use or to aid in more securely holding the writing implement.

Various types of enhanced grips are described in the prior art. In U.S. Pat. No. 6,203,225, Baudino describes a grip with cushioning effect consisting of a plurality of ribs extending parallel to one another and in a plane perpendicular to the implement's longitudinal axis. A raised textured grip composed of a hexagonal pattern for a writing implement in described in U.S. Pat. No. 6,379,065 to Perry. Other grip enhancement devices are described in U.S. Pat. No. 4,932,800 to Lin (compressible gripping device); U.S. Pat. No. 5,143,463 to Pozil (triangular shaped contoured pad); U.S. Pat. No. 5,468,083 to Chesar (triangular attachment); and U.S. Pat. No. 5,558,452 to Oka (coaxial rings around implement). None of these devices, however, provides an enhanced gripping action with a suctioning means and none combine the enhanced gripping with an ergonomic cushioned surface.

While many grip enhancers are known in the art, there remains a need for a grip that is ergonomic, while providing a cushioning effect and improved gripping characteristics.

SUMMARY OF THE INVENTION

It is an object of the present invention to provide a comfortable compressible grip for a handheld implement that provides a cushioning effect.

Another object of the present invention is to provide a more secure ergonomic grip for a handheld implement. This improvement will facilitate better grasping of a handheld implement.

It is yet another object of the present invention to enhance the attachment of a handheld implement to a users hand.

Still another object of this invention is to provide an interesting and attractive texture upon a grip for a handheld implement.

The objects of this invention are accomplished by providing a compressible textured grip with a pattern of small suction cup like structures. Although suction cups are well known as a means of attachment of a device to a surface, they have never been used as a grip enhancer for a handheld implement. Furthermore, this grip enhancer is capable of being incorporated into any number of handheld devices including handheld writing implements. The grip is not only functional but is also interesting and attractive in appearance. The small suction cups facilitate the grasping of the handheld implement or device.

As detailed in the accompanying drawings, the present invention includes a soft pliable grip for a writing implement which is sized according to the shape and size of the barrel of the implement, as well as the typical size of a user's hand and fingers. The grip further includes a base layer and superimposed thereupon, a textured layer of a plurality of generally round rings. The rings having a generally round elevated circumference and a central depression. Placement of the rings may be in some geometric or other arranged fashion, or may be random with respect to the outer surface of the grip. In addition, the elevated rings may be arranged in a concentric pattern.

The grip for a handheld device of the present invention is comprised of a base layer and superimposed on this base layer is a textured layer of a plurality of generally round rings. The said rings having a generally round elevated circumference and a central depression and may be arranged in a geometric or a random pattern about the outer surface of the grip.

Still other objects and advantages of the present invention will become readily apparent to those skilled in the art from the following detailed description, wherein only the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BRIEF DESCRIPTION OF THE DRAWINGS

The foregoing objects, features, advantages and preferred embodiments of the evacuation unit and method of the present invention will be better understood from the following detailed description taken in conjunction with the accompanying drawings in which.

Figure 4:
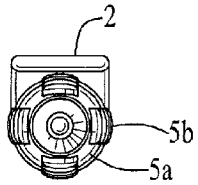
Figure 5:
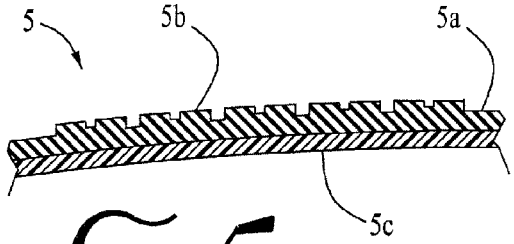

FIG, 3 is a side elevation view of the preferred embodiment of this invention showing the grip of the present invention incorporated into a handheld writing implement;

FIG. 4 is a front elevation view of the preferred embodiment of the present invention showing the grip of the present invention incorporated into a handheld writing implement; and FIG. 5 is a side cross sectional view of the grip for a handheld implement in the preferred embodiment of the present invention.

DETAILED DESCRIPTION OF THE INVENTION

The accompanying Figures depict embodiments of the present invention, and features and components thereof. With regard to means for fastening, mounting, attaching or connecting the components of the present invention to form the apparatus as a whole, unless specifically described otherwise, such means are intended to at least encompass conventional fasteners such as machine screws, machine threads, snap rings, hose clamps such as screw clamps and the like, rivets, nuts and bolts, toggles, pins and the like. Components may also be connected by friction fitting, snap fitting, adhesives, or by welding or deformation, if appropriate. Unless specifically otherwise disclosed or taught, materials for making components of the present invention are selected from appropriate materials such as metal, metallic alloys, natural or synthetic fibers, plastics and the like, and appropriate manufacturing or production methods including casting, extruding, injection molding and machining may be used.

Any references to front and back, right and left, medial and lateral, top and bottom, upper and lower, superior and inferior, and horizontal and vertical are intended for convenience of description, not to limit the present invention or its components to any one positional or spacial orientation.

Figure 1:
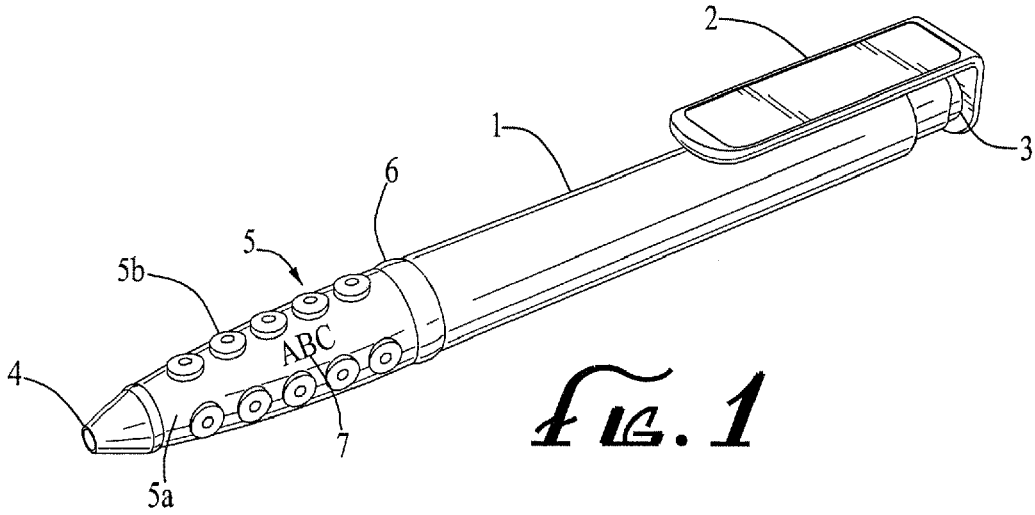
FIG. 1 illustrates a perspective view of the preferred embodiment of this invention showing the grip of the present invention incorporated into a handheld writing implement.

Referring more specifically to the drawings, there is shown in FIG. 1 a preferred embodiment of the grip of the present invention integrated into a handheld writing implement. The handheld writing implement in the preferred embodiment is a pen. The writing implement comprises a barrel 1, a clip 2, an actuator 3, a tip 4, and the compressible textured grip 5. The compressible textured grip 5 is a generally elongated sleeve assembled over the barrel 1 of an implement. A ring like member 6 demarcates the grip from the superior part of the pen. Pressing the actuator 3 causes a ball point ink containing member to protrude or retract from the tip 4. Inside the pen is a typical ball point pen mechanism. The internal mechanisms of a ball point pen are well known in the art and will not be described further herein.

The textured grip 5 may be comprised of various resilient and deformable materials well known in the art for providing a cushioning effect including, for example, foam, leather, or elastomeric materials such as rubber, synthetic rubbers such as polyurethane, silicone, or plastics. Various thermoplasic elastomers commonly used for such devices are well known in the art. As an alternative to the grip 5 being incorporated into the handheld writing implement at the time of manufacture of a pen, the grip may be manufactured as a separate sleeve that may then be applied on any number of elongated handheld devices by the end user. Furthermore, a similarly textured and patterned grip 5 may be used on any number of other handheld devices that are not elongated nor cylindrical, for example, a handheld calculator or cell phone.

Referring now also to FIGS. 2 through 5, the grip 5 of the preferred embodiment of the present invention is a tapered tubular sleeve surrounding the inferior part of the barrel 1 of a handheld writing implement, adjacent to the tip. As shown in FIG. 5 which is a side cross sectional view of the grip 5 of the preferred embodiment, sectioned along the line 5—5 of FIG. 3, the grip 5 of the present invention is comprised of a base layer 5*c*, upon which there is a textured layer 5*a*, superimposed to provide an interesting and attractive texture when gripping the grip in using the handheld implement. The textured layer 5*a* comprises a plurality of elevated rings 5*b* resembling suction cups. The rings 5*b* are arranged around the circumference of the grip 5 and may be arranged in either an organized geometric pattern as shown in the drawings, or they may be located in a random pattern about the outer surface of the grip 5. The base layer 5*c* itself may be smooth or it may have a slightly elevated or raised pattern.

Figure 2:
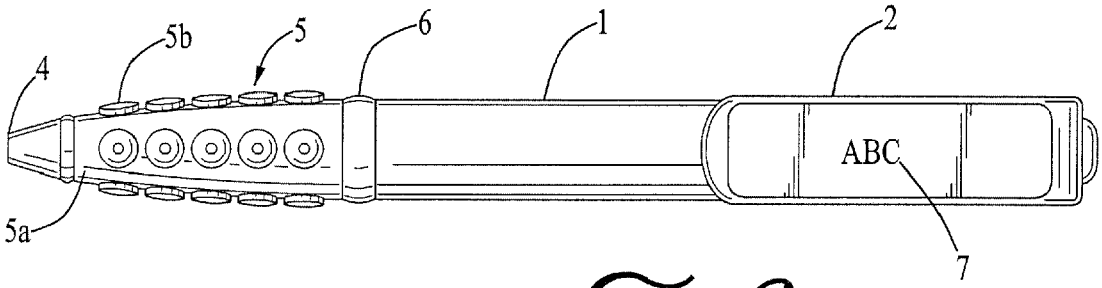
FIG. 2 is a top plan view of the preferred embodiment of the present invention showing the grip of the present invention incorporated into a handheld writing implement.
Figure 3:
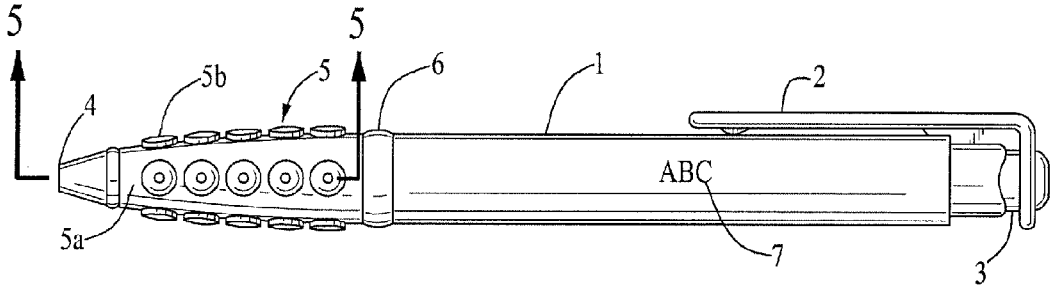

Referring also to FIGS. 1 through 3, advertising or graphical material 7 such as marks, letters, symbols, pictures, or indicia can be imprinted for advertising and promotion upon the grip 5 as shown in FIG. 1, upon the clip 2 as shown in FIG. 2, or upon at least one outer surface of the barrel 1 of the writing implement as shown in FIG. 3.

As shown in more detail in FIGS. 1 through 4, each suction cup like ring 5*b* is comprised of an elevated circumference with a recessed center. This configuration provides a slight suction cup like effect against the fingers of the user of the implement. The suction is such that the present invention facilitates the grasping of the handheld implement. The elevated pattern also provides additional traction during use.

In the figures and specification, there have been disclosed preferred embodiments of the invention. While specific terms are employed, they are used in a generic and descriptive sense only, and not for the purpose of limiting the scope of the invention. The present invention may be embodied in other specific forms without departing from the essential spirit or attributes thereof. It is desired that the embodiments described herein be considered in all respects as illustrative, not restrictive, and that reference be made to the appended claims for determining the scope of the invention.

What is claimed is:

1. A handheld writing implement comprising:

a) an elongated substantially tapered cylindrical implement body having opposing first and second body ends;

b) a clip attached to said first body end, said clip having a generally flat base plate;

c) an extendable pen tip connected to said second body end; and d) a grip comprising:

a base layer sized and configured to be retained over said implement body adjacent said second body end;

a textured layer superimposed on said base layer to provide an interesting and attractive texture upon the grip; and a plurality of rings superposed on said textured layer, each one of said plurality of rings having a generally round elevated circumference and a central depression to enhance attachment through suction effects created by said plurality of rings.

2. The handheld writing implement of claim 1, wherein said base layer is fabricated from a cushioned compressible material.

3. The handheld writing implement of claim 1, wherein said plurality of rings are arranged in a concentric pattern.

4. The handheld writing implement of claim 1, wherein said plurality of rings are arranged in a random pattern.

5. The handheld writing implement of claim 1, wherein advertising material is imprinted on at least one outer surface of said grip for advertising.

6. The handheld writing implement of claim 1, wherein advertising material is imprinted on said flat base plate for advertising.

7. The handheld writing implement of claim 1, wherein advertising material is imprinted on at least one visible outer surface of said implement body for advertising.

8. The handheld writing implement of claim 1, wherein said base layer is frictionally retained over said implement body.

* * * * *